US006101256A

United States Patent [19]

Steelman

[11] Patent Number: 6,101,256

[45] Date of Patent: Aug. 8, 2000

[54] SELF-CONTAINED HELMET COMMUNICATION SYSTEM

[76] Inventor: James A. Steelman, 220 Beach/Prospect St., West Islip, N.Y. 11795

[21] Appl. No.: 08/999,432

[22] Filed: Dec. 29, 1997

[51] Int. Cl.[7] ..... H04R 1/02

[52] U.S. Cl. ..... 381/91; 381/122; 381/367; 381/376

[58] Field of Search ..... 381/91, 300, 309, 381/311, 26, 74, 334, 122, 355, 367, 361, 370, 376; 380/9

[56] References Cited

U.S. PATENT DOCUMENTS 4,949,378 8/1990 Mammone ..... 380/9

*Primary Examiner*—Minsun Oh Harvey
*Attorney, Agent, or Firm*—Kenneth P. Robinson

[57] ABSTRACT

A self-contained helmet communication system is arranged to support oral communication by sending sound waves to and receiving sound waves from an unequipped person positioned near a helmet wearer. The helmet communication system includes a protective helmet having an external microphone and speaker mounted on the helmet. The external microphone, responsive to sound waves external to the helmet, provides signals that are coupled to an internal speaker or earphone to provide a representation of the external sound waves to the wearer. An internal microphone, which is responsive to speech of the helmet wearer, provides signals representative of the helmet wearer's speech that are coupled to an external speaker. Additionally included is a signal coupler with dual audio amplifier channels to couple signals representative of external sound waves from the external microphone to the internal speaker, and to couple signals representative of speech of the wearer from the internal microphone to the external speaker. The helmet communication system may be configured with a power source including a battery unit and a solar cell array.

13 Claims, 2 Drawing Sheets

SELF-CONTAINED HELMET COMMUNICATION SYSTEM

RELATED APPLICATIONS (Not Applicable)

FEDERALLY SPONSORED RESEARCH (Not Applicable)

BACKGROUND OF THE INVENTION

This invention relates to communication systems and, more particularly, to a self-contained helmet based communication system enabling conversation between a wearer and nearby unequipped persons.

The use of safety head gear in the form of protective helmets is common with individuals who engage in a number of activities including riding motorcycles, driving race cars, as well as athletics and other activities. In recent years helmets have been equipped with a variety of full-face shields or masks to provide additional protection to the face of a wearer. A problem associated with the use of helmets, particularly those with full-face shields, is the reduced ability of the wearer to orally communicate with one or more nearby persons. Indeed, some helmets make it nearly impossible for the wearer to communicate orally, especially in noisy environments.

Systems do exist which support communications between a helmet wearer and individuals located at remote stations. These types of systems, which require the helmet wearer and the remote individuals to be properly equipped, typically establish a radio-type communication channel between the helmet and the remote site. For example, wireless receiver/transmitter communication systems, used with protective helmets worn by race car drivers, are well known in the art. These types of systems enable a driver to communicate, on virtually a constant basis, with select members of the driver's pit and support groups. These systems require equipment to be placed at each end of the communications channel, so that each person is "equipped" by access to a microphone and a speaker or headphone connected to the receiver/transmitter equipment.

Systems of the kind discussed above, are of no help when a wearer of a helmet is attempting to orally communicate with a nearby "unequipped" person (not outfitted with any special communication devices or equipment). To orally communicate with such an unequipped person, a wearer would typically have to remove the helmet. In some cases, certain kinds of helmets, such as those including fire and heat shielding means, may be configured so that easy and quick removal is not possible. Further, removal may be hindered due to a confined space, such as within a race car.

Therefore, there is a need for a self-contained communication system that allows a helmet wearer to send sound waves to, and receive sound waves from an unequipped person near the wearer. Objects of the present invention are, therefore, to provide new and improved types of helmet communication systems having one or more of the following capabilities or features:

- a fully self-contained system to support oral communication;
- enable a wearer of a helmet to orally communicate with an unequipped person;
- economical construction using available components;
- all system components mounted to or within helmet;
- powered by replaceable or rechargeable batteries;
- solar recharging of batteries while helmet is worn.

SUMMARY OF THE INVENTION

In accordance with the invention, a self-contained helmet communication system is disclosed to send sound waves to and receive sound waves from a person near a helmet wearer. The helmet communication system is comprised of a helmet supportable on the head of the wearer, which may be a protective-type helmet to protect the head of the wearer. An external microphone device is mounted on the helmet and is responsive to sound waves external to the helmet. One or more external speaker devices are mounted on the helmet to issue sound waves externally to the helmet. An internal microphone device is positioned to be responsive to speech of the wearer, and an internal speaker device is mounted within the helmet to couple sound waves to an ear of the wearer. Additionally included is a signal coupler to couple signals that are representative of external sound waves from the external microphone device to the internal speaker device and to couple signals from the internal microphone device that are representative of speech of the wearer to the external speaker device.

For a better understanding of the invention, together with other and further objects, reference is made to the accompanying drawings, with the scope of the invention pointed out in the appended claims.

BRIEF DESCRIPTION OF THE DRAWINGS

In the drawings, like elements are assigned like reference numerals. The drawings are briefly described as follows.

DETAILED DESCRIPTION OF THE INVENTION

Figure 1:
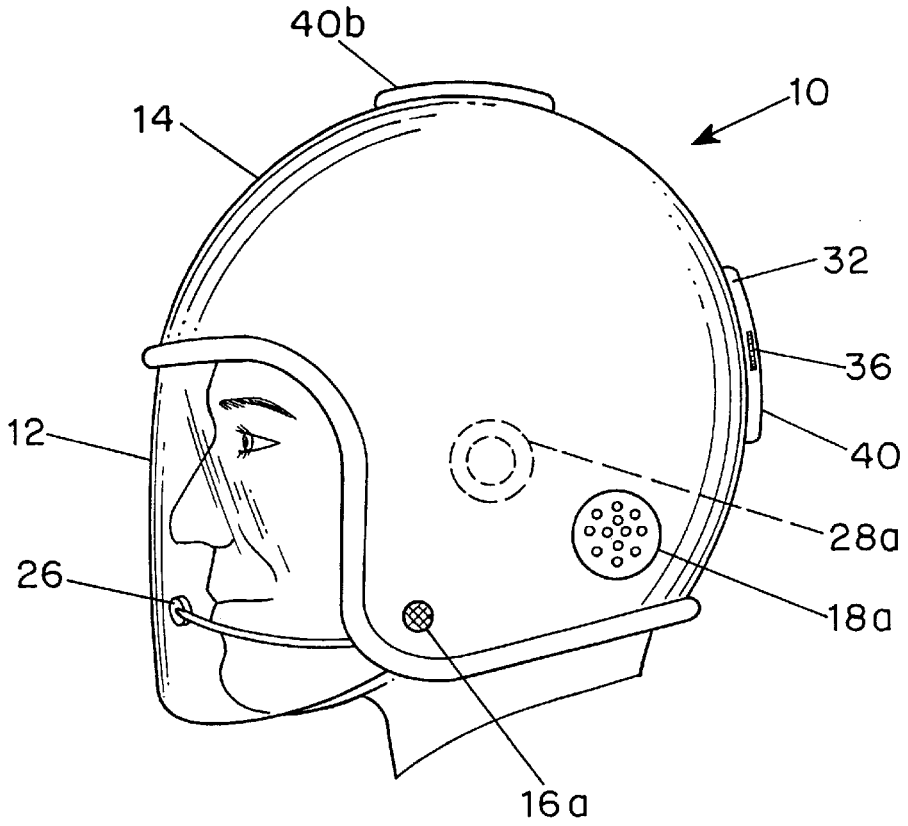
FIG. 1 is a side view of one embodiment of a self-contained communication system in accordance with the invention.

Referring now to FIG. 1, there is illustrated a self-contained helmet communication system 10 in accordance with the present invention, shown as including a helmet 14, which is supportable on the head of the wearer. The helmet 14 is adapted to support other elements of the communication system. Mounted on the helmet 14 is an external microphone device 16*a* which is responsive to sound waves external to the helmet. Such sound waves may typically represent speech of a nearby person or other sounds. An external speaker device 18*a* is mounted on the helmet 14 and arranged to issue sound waves externally to the helmet. The sound waves issued are representative of speech of the wearer of the helmet 14.

As illustrated in FIG. 1, the system includes an internal microphone device 26, which is mounted on the helmet 14 and is responsive to speech of the wearer. The internal microphone device 26 detects sound waves representing speech of the wearer and produces a signal representative of the sound waves. An internal speaker device 28*a*, also mounted on the helmet 14, is included to couple sound waves to an ear of the wearer.

Further included in the FIG. 1 system is a signal coupler 32. The signal coupler 32 is included to couple signals representative of external sound waves from the external microphone device 16*a* to the internal speaker device 28*a* and to couple signals representative of speech of the wearer from the internal microphone device 26 to the external speaker device 18*a*. Signal coupler 32 may include a volume control 36 to permit the level of signals coupled to the internal speaker device 28*a*, and possibly the external speaker device 18*a*, to be adjusted. One embodiment of the signal coupler 32, provided in the form of an audio signal amplifier, will be discussed further when referring to FIG. 4.

For present purposes, the word "helmet" is defined to include a motorcycle or race car driver's helmet, as well as any head gear supportable on the head of the wearer resembling a helmet or otherwise suitable for use in a self-contained communication system in accordance with the invention. Each of microphone devices 16*a* and 26, and speaker devices 18*a* and 28*a*, may be any suitable type of device available for use as a transducer to convert between airborne sound waves, or visa versa. Actual devices can be selected on the basis of size, weight, operating characteristics, cost, durability and other factors relevant to particular applications of the invention. Correspondingly, selection of amplifier devices, connectors, wiring, switches, batteries, solar cells, and other electrical and mechanical components of signal coupler 32 to provide effective and economical intercoupling of signals between the various transducer devices can be made as appropriate for particular applications by skilled persons having an understanding of the invention. Many variations will be apparent to such persons. Thus, the signal coupler unit 32 may be carried on the wearer's belt or in a pocket and connected by a suitable flexible cable. Similarly, transducer components may be fastened or adhered to the helmet, or molded into the helmet, etc.

As configured in FIG. 1, the self-contained communication system 10 is capable of supporting oral communication with a person on the left side of the helmet wearer, and positioned at or near the same height as the wearer. However, components such as the external microphone device 16*a* or the external speaker device 18*a* may be located in positions different from those illustrated. For example, external microphone device 16*a* may be located at any position on the left side of the helmet 14 (and the wearer). It should be noted that the term "left side" is defined as indicating at any position or location on the entire hemispherical left side of the helmet. Similarly, the term "right side" is defined as indicating at any position or location on the entire hemispherical right side of the helmet 14. Thus, if the helmet 14 is to be worn by a race car driver, it may be advantageous to position the external microphone device 16*a* at a location near the top of the helmet 14, favoring one side or the other, and not positioned as shown in FIG. 1. This would allow the driver to communicate with a person standing next to the car, without the person having to bend over or kneel down. This placement, as well as other possible placements are contemplated as being within the scope of the present invention.

As depicted in FIG. 1, the helmet 14 is configured with a full face shield 12, an accessory utilized with a variety of safety helmets currently in use. The face shield 12 provides additional protection to the face of the wearer. However, due to the fact that the shield also covers much of the open front area of the helmet 14, it also severely limits the ability of the wearer to communicate orally with nearby persons. Should a face shield be omitted, the present invention may be employed in a modified embodiment to aid in oral communication between the wearer and a nearby person. Thus, for helmet configurations and applications whereby the wearer may be able to effectively speak to a nearby person, the invention may still be employed to enable the wearer to hear speech of the nearby person. In this embodiment the internal microphone device 26 and external speaker device 18*a* may be omitted, while retaining the external microphone device 16*a* and internal speaker device 28*a*.

Figure 2:
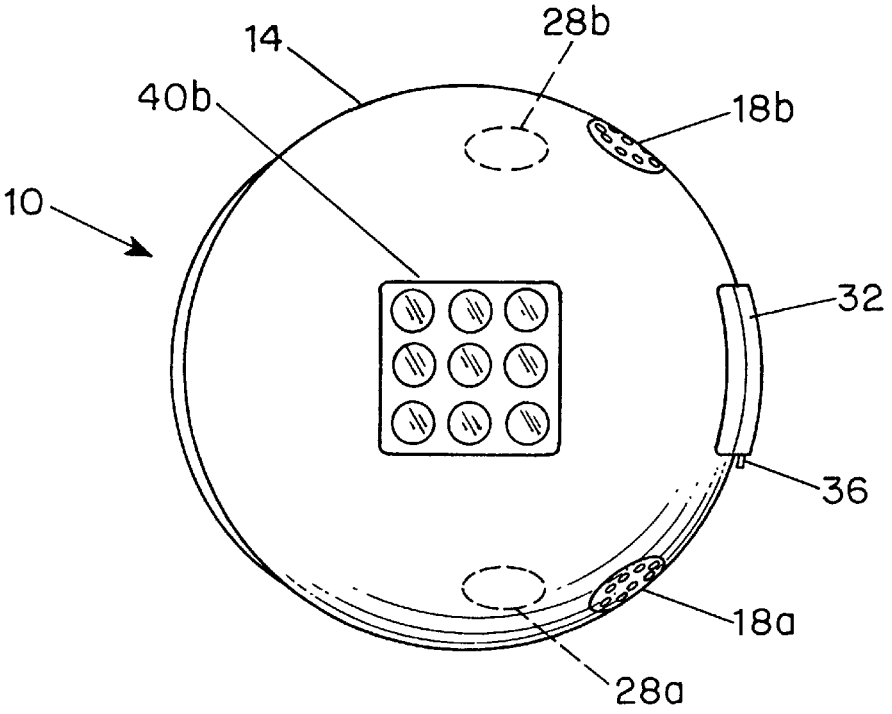
FIG. 2 is a plan view of the FIG. 1 communication system.
Figure 3:
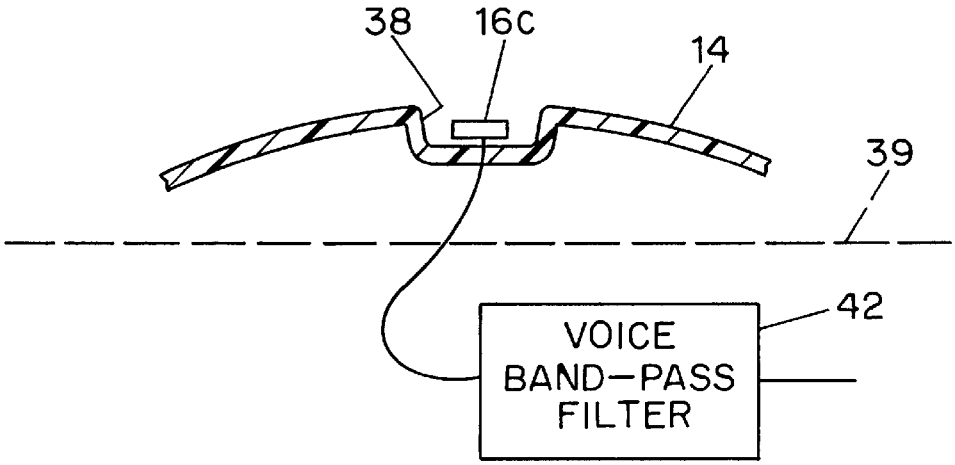
FIG. 3 is a partial, sectional side view showing an alternative mounting of an external microphone.

Referring now to FIG. 2, there is provided a plan view of the FIG. 1 embodiment of the invention. As shown in FIG. 2, a second group of transducers including the external microphone device 16*b*, the external speaker device 18*b*, and internal speaker device 28*b* are mounted on the right side of the helmet. The external microphone device 16*b* and the external speaker device 18*b* are provided to support oral communications with an individual on the right side of the wearer. As stated, it will be understood that placement of the external components including the external microphone devices 16*a* and 16*b*, and the external speaker devices 18*a* and 18*b*, may be varied to achieve desired operating results. For example, with reference to FIG. 3 there is shown a partial, sectional side view of a top portion of helmet 14 including an alternative microphone mounting configuration. As shown, an external microphone 16*c* is mounted in a position at or near the top of the helmet (when the helmet is worn) and located in a depression 38. For a motorcycle operator desiring to communicate with a person standing nearby, the bystander's voice will take the form of sound waves received from a point external to the helmet and located above a horizontal plane represented at 39 which passes through the middle of the helmet. At the same time, the environment near a busy street or at a race track may include relatively loud ambient noise coming largely from engines or tire/road contact. Such ambient noise may thus be largely incident at the wearer's helmet from sub-horizontal angles (at angles below plane 39). Under these conditions, with proper proportioning of depression 38 and selection of microphone 16*c*, the FIG. 3 arrangement will be responsive to sound waves received from external points above horizontal plane 39 and will at least partially impede reception of noise incident from sub-horizontal angles. As also shown in FIG. 3 it may be desirable to include voice band-pass filter 42 as a component of signal coupler 32. Using known techniques for speech processing, electrical signals may be subjected to a filtering effect to favor signals in the range of frequencies representing a speech band, while attenuating other signals.

Further illustrated in FIG. 2 is a solar cell array 40*b* mounted on the upper portion of helmet 14. The solar cell array 40*b* is a component of a power source to power the helmet communication system 10. The power source may be configured to utilize the solar cell array to fully power the communication system 10, or alternatively to recharge rechargeable batteries included with the power source. The solar cell array 40*b* and the power source will be discussed further below. It can be noted that solar cell array 40*b* and microphone 16*c* of FIG. 3 can be positioned one in front of the other, should both be included on a helmet.

Figure 4:
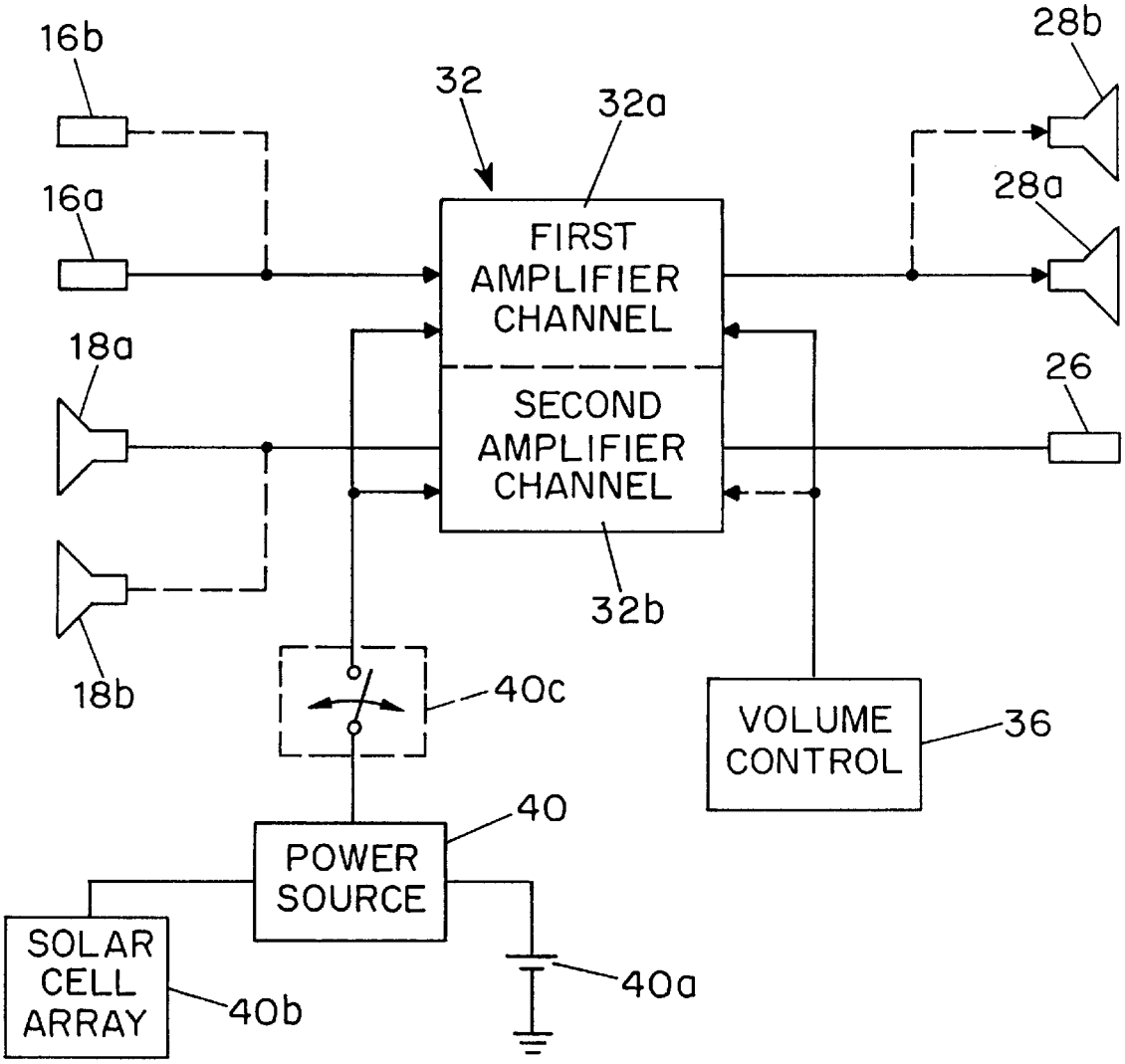
FIG. 4 is a functional block diagram of components of an embodiment of a helmet communication system of the invention.

Referring now to FIG. 4 there is provided a functional block diagram of an embodiment of the helmet communication system 10 of the present invention, exclusive of helmet 14. This embodiment, as illustrated includes a first communication channel comprising a first amplifier channel 32*a* coupling the external microphone device 16*a* to the internal speaker device 28*a*, and a second communication channel comprising a second amplifier channel 32*b* to couple the internal microphone device 26 to the external speaker device 18*a*. Persons skilled in the art will understand the variety of approaches that may be used to implement arrangements suitable for different applications. A low cost configuration may, for example, comprise of one or more integrated circuit (IC) devices. A higher cost configuration may employ analog filtering and signal conditioning, and/or digital signal processing (DSP) techniques to ensure that high quality sound is coupled from a microphone device to a speaker device. A variety of approaches and circuits may be employed to provide the necessary signal coupling.

As illustrated in FIG. 4, the signal coupler 32 is provided as an audio signal amplifier, which as shown may be comprised of a first amplifier channel 32*a* and a second amplifier channel 32*b* with associated components and wiring suitable to interconnect and support the operation of the various transducers. The first amplifier channel 32*a* provides coupling between the external microphone device 16*a* and the internal speaker device 28*a*. The signal provided by the external microphone device 16*a*, which is representative of external sound waves, such as speech of a nearby person, is boosted by the first amplifier channel 32*a* to an appropriate level to properly drive the internal speaker device 28*a*. A volume control 36 may be included to permit the wearer to adjust the level of the signal coupled to the internal speaker device 28*a*. The second amplifier channel 32*b* provides coupling between the internal microphone device 26 and the external speaker device 18*a*. The internal microphone device 26 is responsive to speech of the wearer and provides a signal that is boosted by the second amplifier channel 32*b* to an appropriate level to properly drive the external speaker device 18*a* to issue externally a representation of the wearer s speech. It can be noted that the second amplifier channel 32*b* may also be configured to be responsive to volume control 36. Alternatively, the second amplifier channel 32*b* may be configured with a volume controlling means such as an automatic gain control (AGC) circuit to automatically adjust the sound level coupled to external speaker device 18*a*.

Devices such as audio signal amplifiers 32*a* and 32*b* as provided in FIG. 4 can be adapted to allow for the inclusion of additional external microphone devices, such as external microphone device 16*b*. Similarly, additional external speaker devices, such as external speaker device 18*b*, may be readily included. It should be noted that if the helmet communication system 10 is configured with a second external microphone device such as 16*b*, first amplifier channel 32*a* may be altered to include two independent volume controls, one for each external microphone. This modification would allow the wearer to independently adjust the coupling of each external microphone device 16*a* and 16*b* and select the desired external sound source. It should also be noted that the internal speaker devices 28*a* and 28*b* may be provided as earphone devices. Indeed, skilled persons will appreciate the variety of configurations which are possible with various combinations of microphone and speaker devices available in the art.

Referring again to FIG. 4, illustrated is a power source 40, including one or more battery units 40*a*. The power source 40 may further include an array of solar cells 40*b*. With battery units 40*a* provided as rechargeable batteries, the inclusion of the solar cell array 40*b* provides a power source to recharge battery units 40*a* when the ambient light intensity is at a sufficient level. On/Off switch 40*c* may be included to allow the helmet communication system 10 to be selectively powered on or off.

While there have been described the currently preferred embodiments of the present invention, those skilled in the art will recognize that other and further modifications may be made without departing from the invention and it is intended to claim all modifications and variations as fall within the scope of the invention.

What is claimed is:

1. A self-contained helmet communication system, to send sound waves including spoken words to and receive sound waves including spoken words from a person near a helmet wearer, comprising:

a helmet supportable on the head of the wearer;

an external microphone device mounted on said helmet and responsive to spoken words of said person;

an external speaker device mounted on said helmet and arranged to replicate spoken words of the wearer;

an internal microphone device mounted on said helmet and responsive to spoken words of the wearer;

an internal speaker device mounted on said helmet and arranged to replicate spoken words of said person to an ear of the wearer; and a signal coupler to couple signals representative of spoken words of said person from said external microphone device to said internal speaker device and to couple signals representative of spoken words of the wearer from said internal microphone device to said external speaker device;

the communication system arranged to enable an unequipped person near the helmet wearer to orally communicate with the helmet wearer via the communication system.

2. A self-contained helmet communication system as in claim 1, wherein said signal coupler includes at least one audio signal amplifier arranged to amplify said signals representative of external sound waves.

3. A self-contained helmet communication system as in claim 1, wherein said signal coupler comprises a dual channel audio signal amplifier, said dual channel amplifier having a first amplifier channel coupled between said external microphone device and said internal speaker device and a second amplifier channel coupled between said internal, microphone device and said external speaker device.

4. A self-contained helmet communication system as in claim 1, wherein said external microphone device is mounted on the top portion of said helmet and arranged to be responsive to sound waves received from external points above a horizontal plane passing through the middle of said helmet.

5. A self-contained helmet communication system as in claim 1, wherein said external microphone device is mounted on the top portion of said helmet in a depression effective to at least partially impede reception of noise incident from sub-horizontal angles.

6. A self-contained helmet communication system as in claim 1, wherein said signal coupler includes a filter effective to reduce coupling of signals representative of sounds outside of a selected speech frequency band.

7. A self-contained helmet communication system as in claim 1, additionally comprising a power source including solar cells.

8. A self-contained helmet communication system as in claim 1, additionally comprising a power source including rechargeable batteries and solar cells arranged to recharge said batteries.

9. A self-contained helmet communication system, to send sound waves including spoken words to and receive sound waves including spoken words from a person near a helmet wearer, comprising:

a protective helmet to protect the head of the wearer;

a first communication channel built into said helmet and including an internal earphone device coupled, via an amplifier channel, to an external microphone device arranged to couple a replication of external spoken words to an ear of said wearer; and a second communication channel built into said helmet and including an internal microphone device coupled, via an amplifier channel, to an external speaker device arranged to issue external to the helmet a replication of spoken words of the wearer;

the communication system arranged to enable an unequipped person near the helmet wearer to orally communicate with the helmet wearer via the communication system.

10. A self-contained helmet communication system as in claim 9, wherein said external microphone device is mounted on the top portion of said helmet in a depression effective to at least partially impede reception of noise incident from sub-horizontal angles.

11. A self-contained helmet communication system as in claim 9, wherein said external microphone device is mounted on the top portion of said helmet and arranged to be responsive to sound waves received from external points above a horizontal plane passing through the middle of said helmet.

12. A self-contained helmet communication system as in claim 9, wherein said signal coupler includes a filter effective to reduce coupling of signals representative of sounds outside of a selected speech frequency band.

13. A self-contained helmet communication system as in claim 9, additionally comprising a power source including rechargeable batteries and solar cells arranged to recharge said batteries.

* * * * *